US008281942B2

(12) United States Patent
Meltzer

(10) Patent No.: US 8,281,942 B2
(45) Date of Patent: Oct. 9, 2012

(54) FOLDING AND WALL-MOUNTABLE FRAME SUCH AS FOR A DRYING DEVICE

(75) Inventor: Reinout Ignatius Maximiliaan Maria Meltzer, Rotterdam (NL)

(73) Assignee: Brabantia Nederland B.V., Waalre (NL)

( * ) Notice: Subject to any disclaimer, the term of this patent is extended or adjusted under 35 U.S.C. 154(b) by 498 days.

(21) Appl. No.: 11/631,086

(22) PCT Filed: Jun. 28, 2005

(86) PCT No.: PCT/NL2005/000458

§ 371 (c)(1),
(2), (4) Date: Oct. 8, 2008

(87) PCT Pub. No.: WO2006/004397

PCT Pub. Date: Jan. 12, 2006

(65) Prior Publication Data

US 2009/0084744 A1 Apr. 2, 2009

(30) Foreign Application Priority Data

Jul. 1, 2004 (NL) ..... 1026543

(51) Int. Cl.
*A47H 1/10* (2006.01)
*A47B 57/00* (2006.01)
*A45B 11/00* (2006.01)

(52) U.S. Cl. ..... 211/100; 211/104; 211/197; 135/21

(58) Field of Classification Search ..... 211/1.3, 211/85.24, 94.03, 95, 96, 99, 100, 104, 105, 211/165, 169, 171, 172, 193, 195, 196, 197, 211/202, 205; 135/20.1, 21, 25.1, 25.2, 98; 248/277.1

See application file for complete search history.

(56) References Cited

U.S. PATENT DOCUMENTS

| | | | | | |
|---|---|---|---|---|---|
| 66,520 | A | * | 7/1867 | Redding | 211/209 |
| 76,305 | A | * | 4/1868 | Crouse | 211/165 |
| 92,905 | A | * | 7/1869 | Toune | 211/165 |
| 108,575 | A | * | 10/1870 | Emmerl | 211/165 |
| 131,483 | A | * | 9/1872 | Valkenburgh | 211/163 |
| 359,275 | A | * | 3/1887 | Orr | 211/165 |
| 452,233 | A | * | 5/1891 | McKinnan et al. | 211/165 |
| 595,947 | A | * | 12/1897 | Hill | 211/95 |
| 619,902 | A | * | 2/1899 | Morrissey | 211/95 |
| 641,586 | A | * | 1/1900 | French | 211/167 |
| 845,248 | A | * | 2/1907 | Morgan | 211/95 |
| 882,960 | A | * | 3/1908 | Peterson | 211/197 |

(Continued)

FOREIGN PATENT DOCUMENTS

DE 8411355 5/1984

(Continued)

*Primary Examiner* — Darnell Jayne
*Assistant Examiner* — Joshua Rodden
(74) *Attorney, Agent, or Firm* — The Webb Law Firm

(57) ABSTRACT

A frame which can be moved between a folded-in position and a folded-out position includes suspension means for suspending the frame from a vertical element, an arm assembly having at least three arms and a rod assembly which cooperates with the arm assembly. The arm and rod assemblies are designed such that the arms may extend between a folded-in position and a folded-out position. The suspension means cooperate with a section of the arm assembly and/or with a section of the rod assembly which is/are at the periphery of the planes defined by the assemblies.

22 Claims, 7 Drawing Sheets

U.S. PATENT DOCUMENTS

| | | | | | |
|---|---|---|---|---|---|
| 908,290 | A | * | 12/1908 | Madland | 211/165 |
| 940,729 | A | * | 11/1909 | Robinson | 211/95 |
| 1,021,694 | A | * | 3/1912 | McGeary | 211/95 |
| 1,205,773 | A | * | 11/1916 | Michaud | 211/95 |
| 1,274,284 | A | * | 7/1918 | Kraviecz | 211/95 |
| 1,727,761 | A | * | 9/1929 | Frantz | 211/105 |
| 1,740,653 | A | | 12/1929 | Hunneman, Jr. | |
| 2,670,855 | A | * | 3/1954 | Pierie | 211/197 |
| 2,884,138 | A | * | 4/1959 | Angelo | 211/95 |
| 3,163,297 | A | * | 12/1964 | Raynor | 211/197 |
| 4,550,840 | A | * | 11/1985 | Van Deursen | 211/197 |
| 4,586,525 | A | * | 5/1986 | Glatz et al. | 135/20.1 |
| 4,735,326 | A | * | 4/1988 | Steiner | 211/197 |
| 5,116,258 | A | * | 5/1992 | Vennik | 135/20.3 |
| 5,927,310 | A | * | 7/1999 | Lin | 135/20.1 |
| 5,960,806 | A | * | 10/1999 | Steiner | 135/20.1 |
| 6,230,727 | B1 | * | 5/2001 | Chen | 135/98 |
| 6,401,735 | B1 | * | 6/2002 | Chou | 135/20.1 |
| 6,598,990 | B2 | * | 7/2003 | Li | 362/102 |
| 6,694,993 | B2 | * | 2/2004 | Chou | 135/98 |
| 6,923,193 | B2 | * | 8/2005 | Chen | 135/20.1 |
| 7,156,114 | B2 | * | 1/2007 | Lo | 135/21 |
| 2003/0140955 | A1 | * | 7/2003 | Chou | 135/98 |
| 2006/0169307 | A1 | * | 8/2006 | Lo | 135/20.1 |

FOREIGN PATENT DOCUMENTS

| | | | |
|---|---|---|---|
| DE | 4319004 | A1 | 12/1994 |
| DE | 9321146 | U1 | 12/1994 |
| FR | 806084 | | 12/1936 |
| FR | 2151187 | | 4/1973 |

* cited by examiner

FOLDING AND WALL-MOUNTABLE FRAME SUCH AS FOR A DRYING DEVICE

BACKGROUND OF THE INVENTION

1. Field of the Invention

The invention relates to a frame which can be moved between a folded-in position and a folded-out position and which is provided with suspension means intended for suspending the frame from a vertical element, an arm assembly comprising at least three arms which, at one end, are hingedly connected to an arm joint and a rod assembly, the rods of which, at one end, are hingedly connected to a rod joint which cooperates with the arm assembly, which assemblies are designed such that the arms extend substantially in the same direction in the folded-in position at a relatively small distance next to one another and occupy a relatively small area in a direction transverse thereto, and in the folded-out position occupy a relatively large area in a direction transverse thereto.

2. Description of Related Art

A frame of this type is known for example from rotary clotheslines. These rotary clotheslines have a central column or pole, relative to which usually four arms can be folded out or in. The pole has to be placed in a sleeve which is arranged in the ground, or in a base which serves to ensure the stability of the drying device.

Although the known rotary clotheslines have been in use for a long time and are also relatively user-friendly, they nevertheless also have drawbacks. The fact is that a rotary clothesline is often not installed permanently in a specific position. This is due to the space a rotary clothesline occupies; even in the folded-in position, the rotary clothesline is an inconvenient obstacle. Furthermore it is often not a viable option to install the rotary clothesline permanently because of its less attractive appearance.

For these reasons, the rotary clothesline is re-installed with every use and then removed again. This is inconvenient and leads to the user being less satisfied. In addition, this makes it less attractive to use the rotary clothesline for small amounts of washing.

SUMMARY OF THE INVENTION

It is therefore an object of the invention to provide a frame of the abovementioned type, for example for a drying device, which does not have these drawbacks. This object is achieved by the suspension means cooperating with a section of the arm assembly and/or with a section of the rod assembly which is/are at the periphery of the planes defined by the frame.

Positioning the suspension means on the periphery of the frame results in a number of advantages which were hitherto impossible to achieve with the known rotary clotheslines. First and foremost, it is no longer necessary to use a pole. As there no longer is a pole under the frame, the frame can be used to better advantage. Another important fact is that the frame can be folded up, for example against a wall. Such a position is usually at such a distance from the open space that it is not inconvenient to permanently attach the frame which has been folded in such a manner to a wall or the like. This increases user-friendliness. It is then no longer necessary to hang the frame or put it away each time it is being used. The frame only has to be folded out and is then ready for use.

The suspension means can in particular be connected to at least one of the arms; alternatively or additionally, the suspension means are connected to at least one of the rods. As is conventional, the arms are hingedly connected at one end to an arm joint and the rods of the rod assembly are hingedly connected at one end to a rod joint; each of these rods is connected to an associated arm at a distance from the rod joint by means of a hinge pin, which hinge pin is located between the ends of this arm.

According to a preferred embodiment of the invention, one of these rods extends beyond the hinge pin of the associated arm; this rod and arm support the suspension means at their end which is remote from the end remote from the rod joint and arm joint, respectively. The aim joint and the arms are provided with stops which interact with one another in the folded-out position; the rod joint and the rods are likewise provided with stops which interact with one another in the folded-out position.

The arm which is provided with the suspension means is preferably designed in two sections, comprising two parallel arm sections enclosing a gap. The associated rod which is also provided with suspension means is accommodated between those arm sections and hingedly connected thereto.

The suspension means connected to the arm preferably comprise a suspension piece which can be connected to the vertical element, which suspension piece is connected to the arm by means of a fixed hinge; the suspension means connected to the rod preferably comprise a detachable coupling.

The detachable coupling can be designed in various ways. By way of example, an embodiment is mentioned in which the detachable coupling comprises a base piece which can be connected to the vertical element and counterpiece connected to the rod, which base piece has at least one stop face and which counterpiece has at least one stop element such that the stop face is directed transversely to the rod in the stop position of the rod, in which the stop element bears against the stop face. By tilting the frame about the fixed coupling of the arm, the rod can be coupled and uncoupled, respectively. Such a coupling movement is easy to carry out when putting the frame away or putting it out to use.

Furthermore, locking means may be provided for locking the rod relative to the base piece. These locking means may comprise a snap element which is under resilient prestress and can be displaced counter to the spring prestress by the counterpiece and which, once the stop position of the counterpiece has been reached, can rebound relative to the base piece in order to lock the counterpiece relative to the base piece.

In a very stable embodiment, two stop faces and associated stop elements may be provided, the snap element being located between the two stop faces.

A guide may be provided opposite each stop face, which stop face and which guide enclose a guide slot in such a manner that the associated stop element can be guided to the stop position through the guide slot.

The suspension means may comprise a suspension plate which is connected to one of the arms and one of the rods; the suspension means can preferably pivot about a hinge pin which is parallel to the direction in which the folded-in arms extend.

The invention also relates to a drying device, comprising a frame as described above, and to lines extending in each case between two neighboring arms. Finally, the invention relates to a screen device comprising a frame of this type and screens extending in each case between two neighboring arms.

BRIEF DESCRIPTION OF THE DRAWINGS

The invention will be described in more detail below with reference to an exemplary embodiment of a frame which forms a section of a wall drier illustrated in the figures, in which.

DETAILED DESCRIPTION OF THE INVENTION

Figure 1:
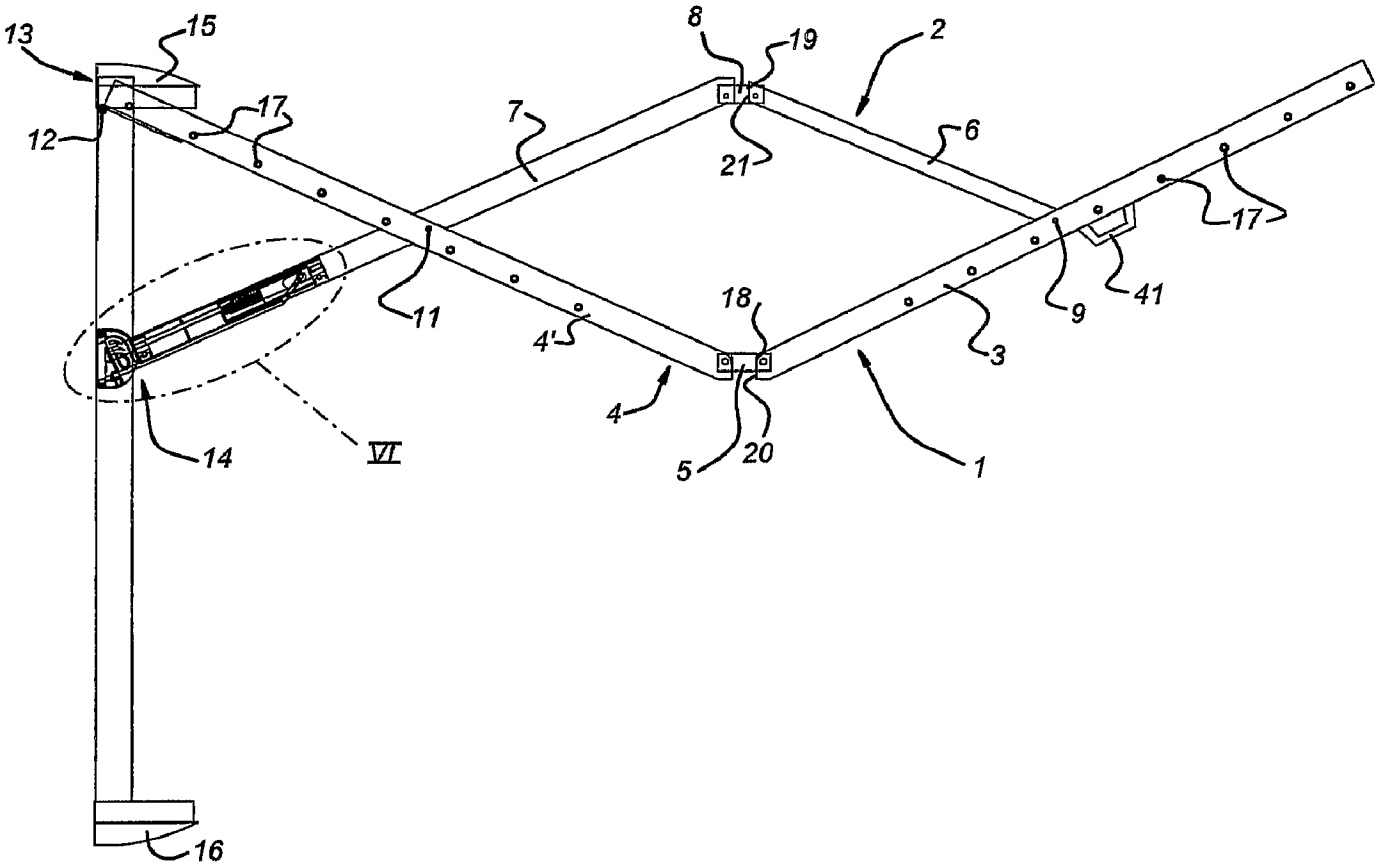
FIG. 1 shows a vertical section through the wall drier according to the invention in the folded-out position.

The wall drier illustrated in FIGS. 1-3 and 5 comprises an arm assembly denoted overall by reference numeral 1 and a rod assembly denoted in its entirety by reference numeral 2. In the exemplary embodiment shown, the arm assembly comprises four arms 3, 4, which are hingedly connected to one another at the arm joint 5. The rod assembly comprises four rods 6, 7 which are hingedly connection to one another by a rod joint 8.

Figure 2:
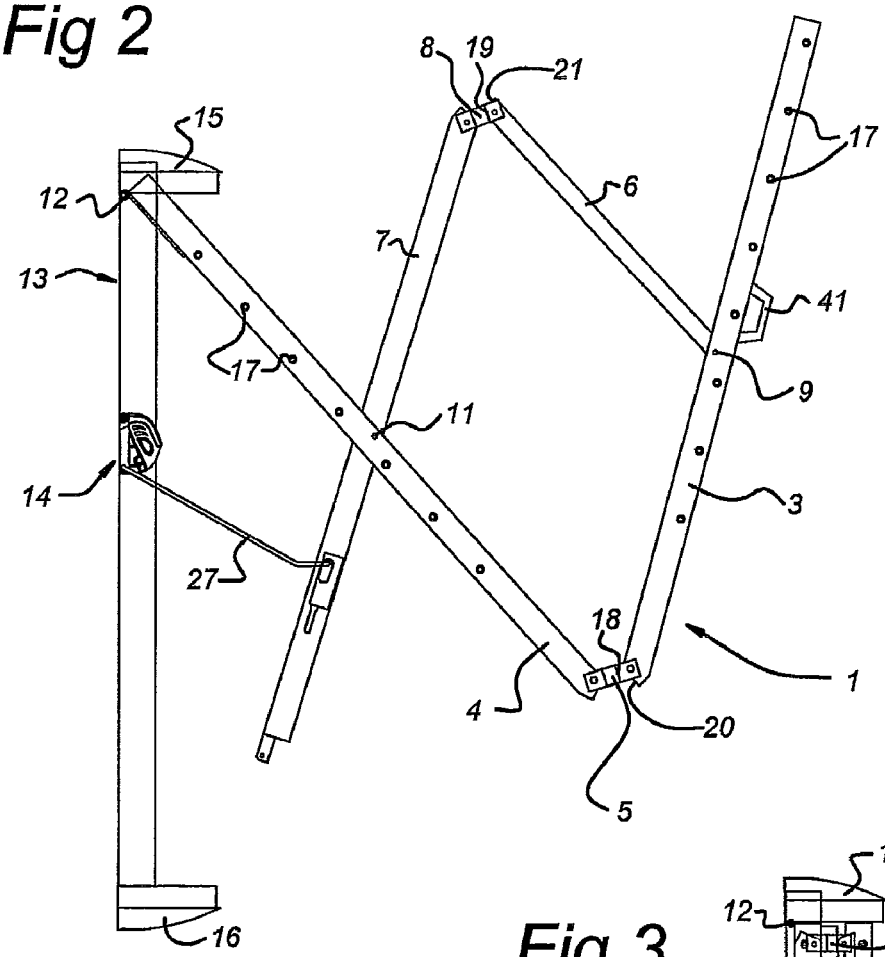
FIG. 2 shows the semi-folded position.
Figure 3:
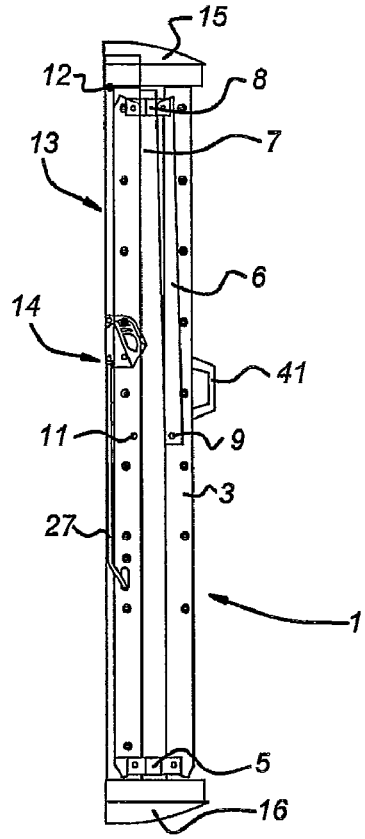
FIG. 3 shows the folded-in position.
Figure 4:
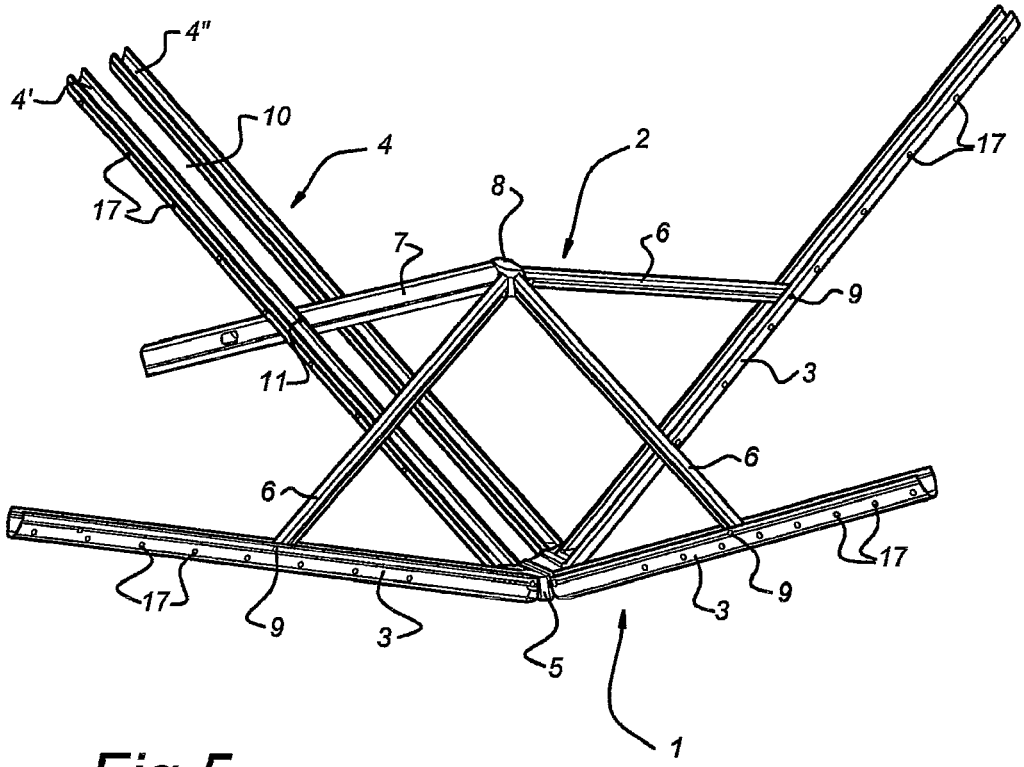
FIG. 4 shows a perspective view of the folded-out frame of the wall drier according to FIGS. 1-3.
Figure 5:
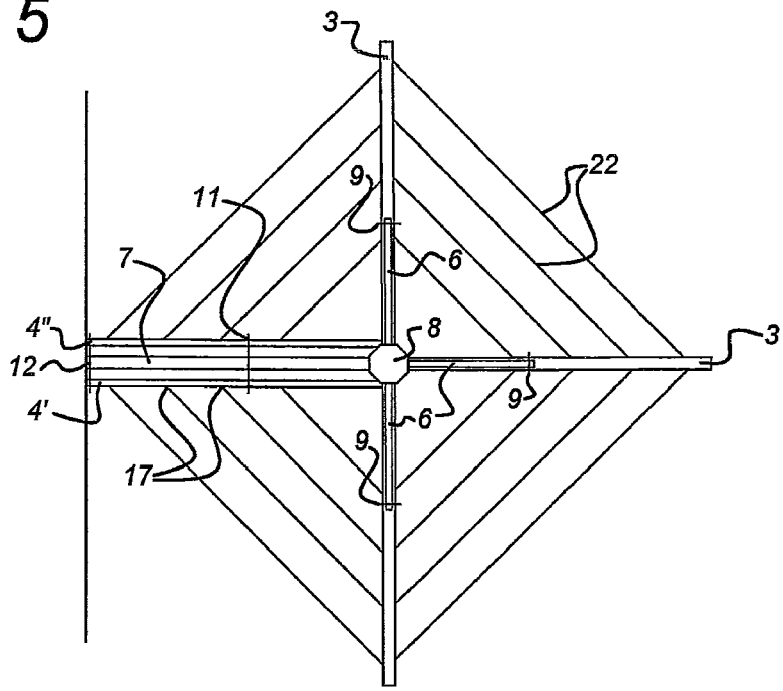
FIG. 5 shows a plan view of the folded-out wall drier.

Approximately halfway along its length, each of the arms 3 is connected to a rod 6 by means of a respective hinge 9. As illustrated in FIGS. 1-3, a handle 41 is provided on a section of the arm assembly 1 which is remote from the section of the arm assembly 1 on which a suspension piece 13 is provided. The arm 4 is designed in two sections and comprises two adjacent arm sections 4', 4", which enclose a gap 10 between them. The rod 7 is accommodated in this gap. This rod 7 is hingedly connected to both arm sections 4', 4" of the arm 4 by means of a hinge 11 (see FIGS. 3 and 4). The rod 7 has centering tracks 40 which extend transverse to its longitudinal direction for centering the rod 7 between the coupling parts 27 when the rod 7 is swung to the coupled state.

As illustrated in FIGS. 1 to 3, the end of the arm sections 4', 4" remote from the arm joint 5 is connected to the suspension piece 13 by means of the hinge 12. The suspension piece 13 can pivot about a hinge pin 12 which is perpendicular to the direction in which the arms 3, 4 extend in the folded-in position. The rod 7 is connected in turn to the suspension piece 13 by means of a detachable coupling 14. The detachable coupling 14 includes a base piece 23 which can be connected to the vertical element, and a counterpiece 25, e.g., a pin 25, connected to the rod 7, which base piece 23 has at least one stop face 24 and which counterpiece 25 has at least one stop element such that the stop face 24 is directed transversely to the rod 7 in the stop position of the rod 7, in which the stop element bears against the stop face. The suspension piece 13 has a top cover 15 and a bottom cover 16, within the contour of which the rod 7 and arms 3, 4 of the frame can fall in the folded-in position. The suspension piece 13 may, for example, be attached to a wall, i.e., the vertical element. Incidentally, the other portion of the suspension piece 13, which is below the coupling 14, can also be omitted.

Each of the arms 3, 4 has holes 17 for passing washing lines through, which are taut when the frame is in its folded-out position. In the plan view of FIG. 5, the washing lines 22 are illustrated which are pulled taut between the arms 3, 4.

Both the arm joint 5 and the rod joint 8 have stops 18 and 19, respectively, against which the flat sides 20 and 21 of the arms 3, 4 and 6, 7, respectively, come to bear in the completely folded-out position. Thus a stable folded-out position of the frame is ensured.

The enlarged detail of FIGS. 6*a* to 8 illustrates the detachable coupling 14. This coupling comprises a base piece 23 which has a stop face 24. In the coupled state, the longitudinal direction of the rod 7 runs approximately perpendicular to the stop face 24. As a result, the pin 25 connected to this rod 7 rests against the stop face 24 in a stable manner.

Figure 10:
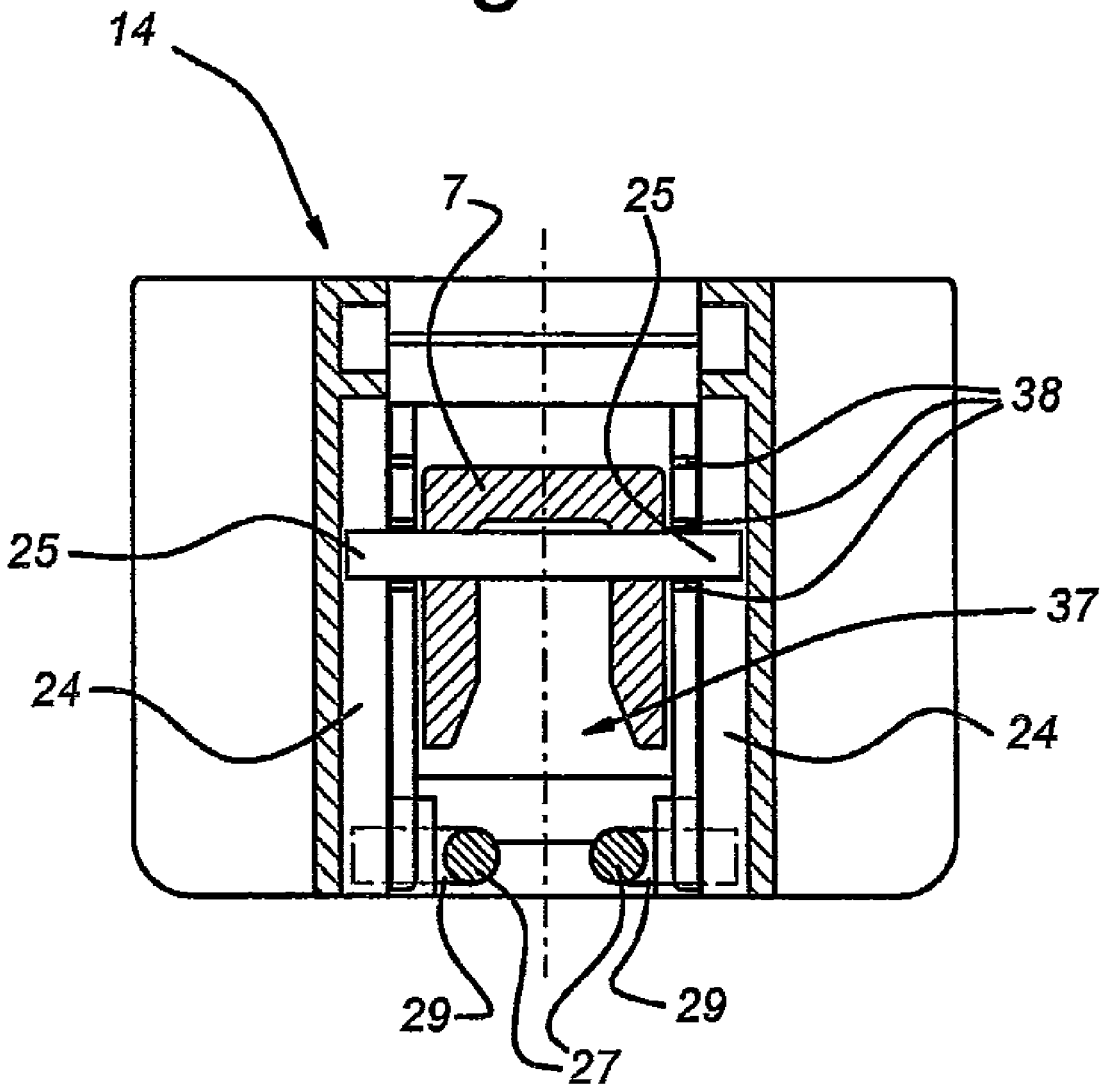
FIG. 10 shows the view X-X from FIG. 6*c*.

When the arm 7 is coupled to the base piece 23, the pin 25 slides along the stop face 24 and beyond the snap element 37 (see also FIG. 10). This can be resiliently pushed back counter to the prestress, for example by spring 39. Once the pin 25 has parried the snap element 37, the snap element 37 snaps back and the arm 7 is locked behind the nose 38 of the snap element 37.

Figure 6A:
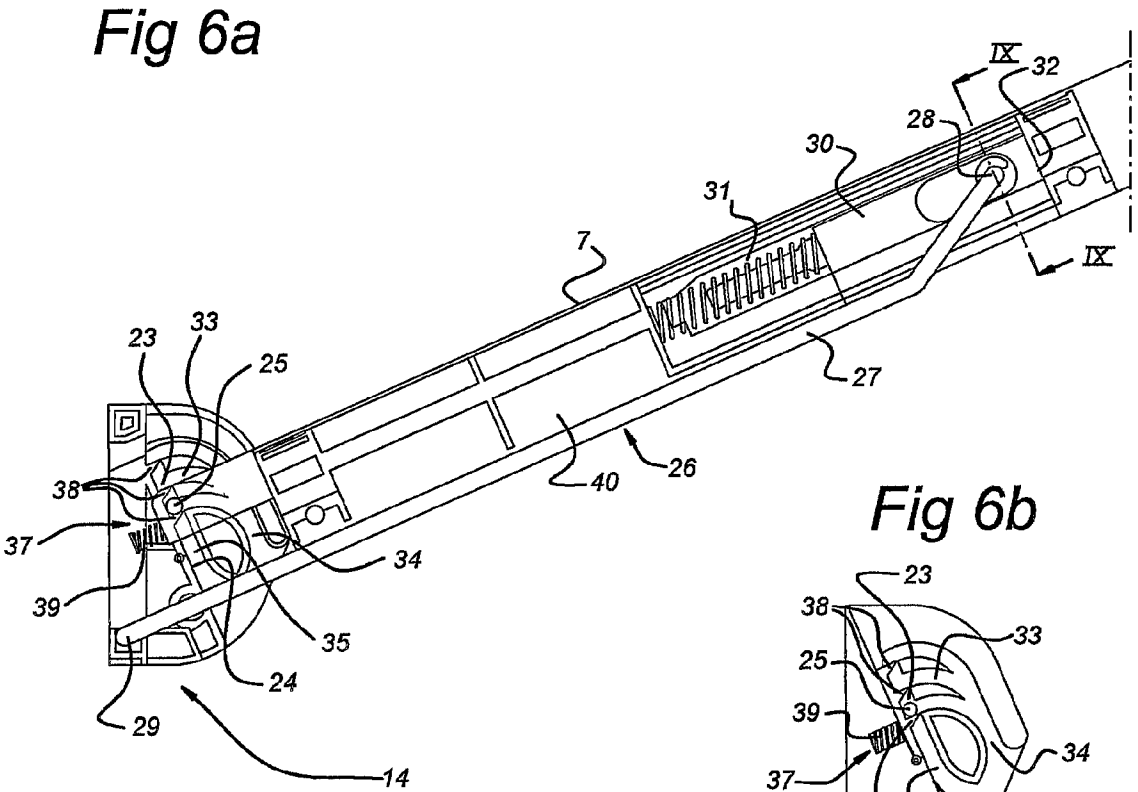
FIG. 6*a* shows a detail on an enlarged scale according to VI of FIG. 1.
Figure 6B:
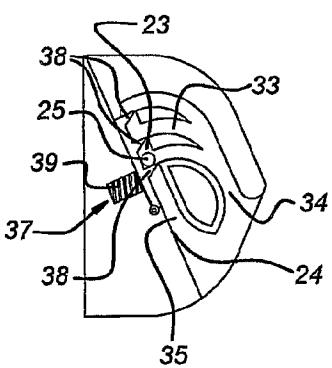
FIG. 6*b* shows the operational principle of the detail of FIG. 6.
Figure 6C:
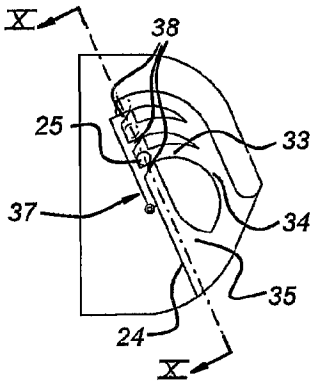
FIG. 6*c* shows the locking action of the detail of FIG. 6*a;*
Figure 9:
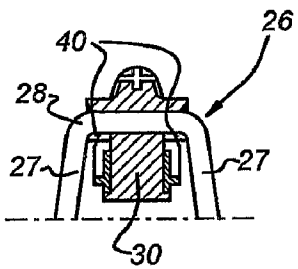
FIG. 9 shows a cross section along IX-IX according to FIG. 6.

The arm 7 is furthermore connected to the base piece 23 by the coupling element 26. To this end, the coupling element 26, which has two parallel arms 27 (see also FIG. 9), is connected on one side to the rod 7 via hinge 28 and on the other side to the base piece 23 via hinge 29. The hinge 28 is accommodated in a sliding piece 30, which is held against the stop face 32 by means of the prestressing spring 31, i.e. away from the base piece 23. In the position of FIG. 6, the spring 31 thus continuously pushes the pin 25 against the stop face 24. The coupling element 26 also facilitates displacement of the pin 25 in the slot 35 and over the stop face 24.

Figure 7:
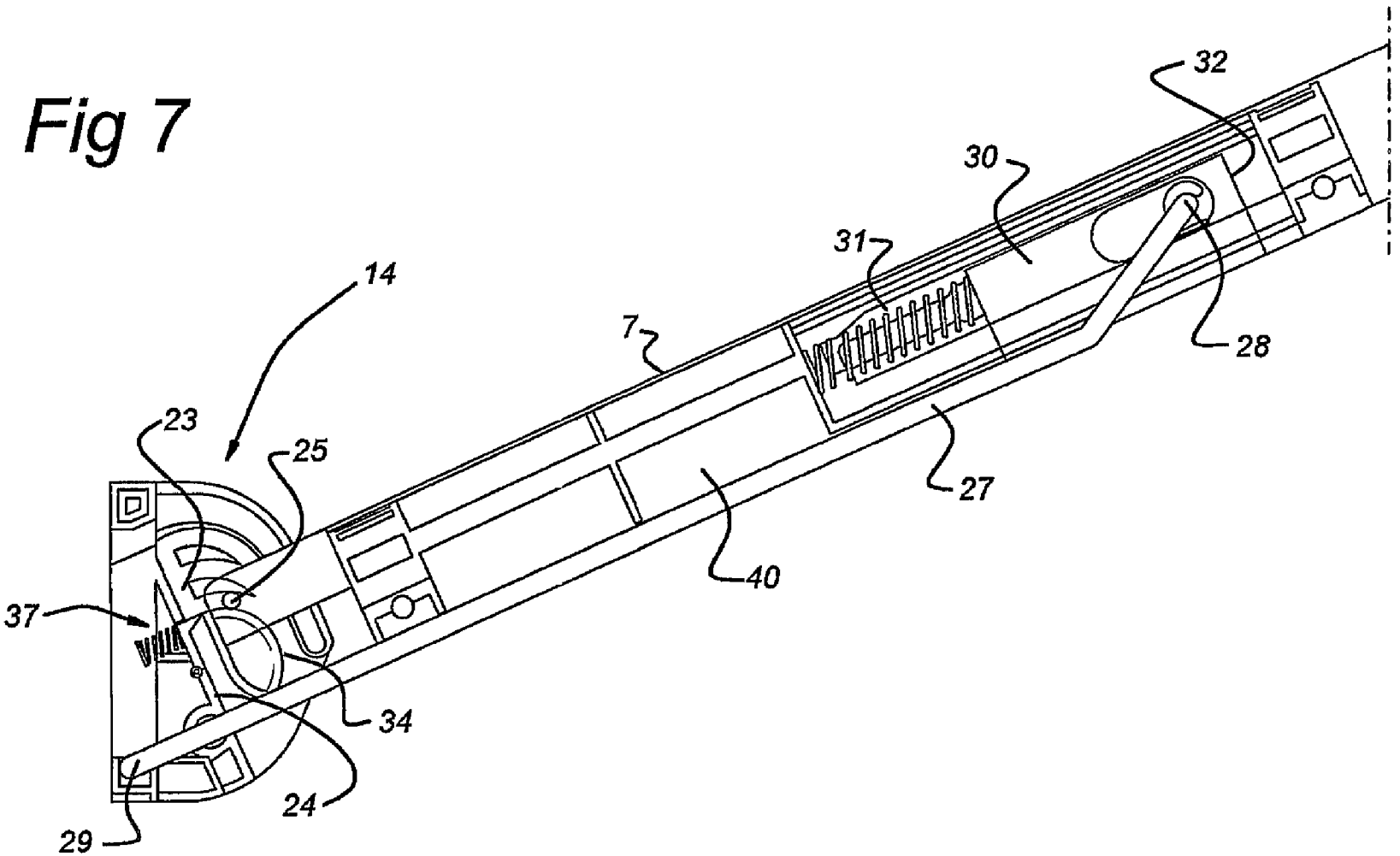
FIG. 7 shows the detail of FIG. 6 in the position where it is almost locked.
Figure 8:
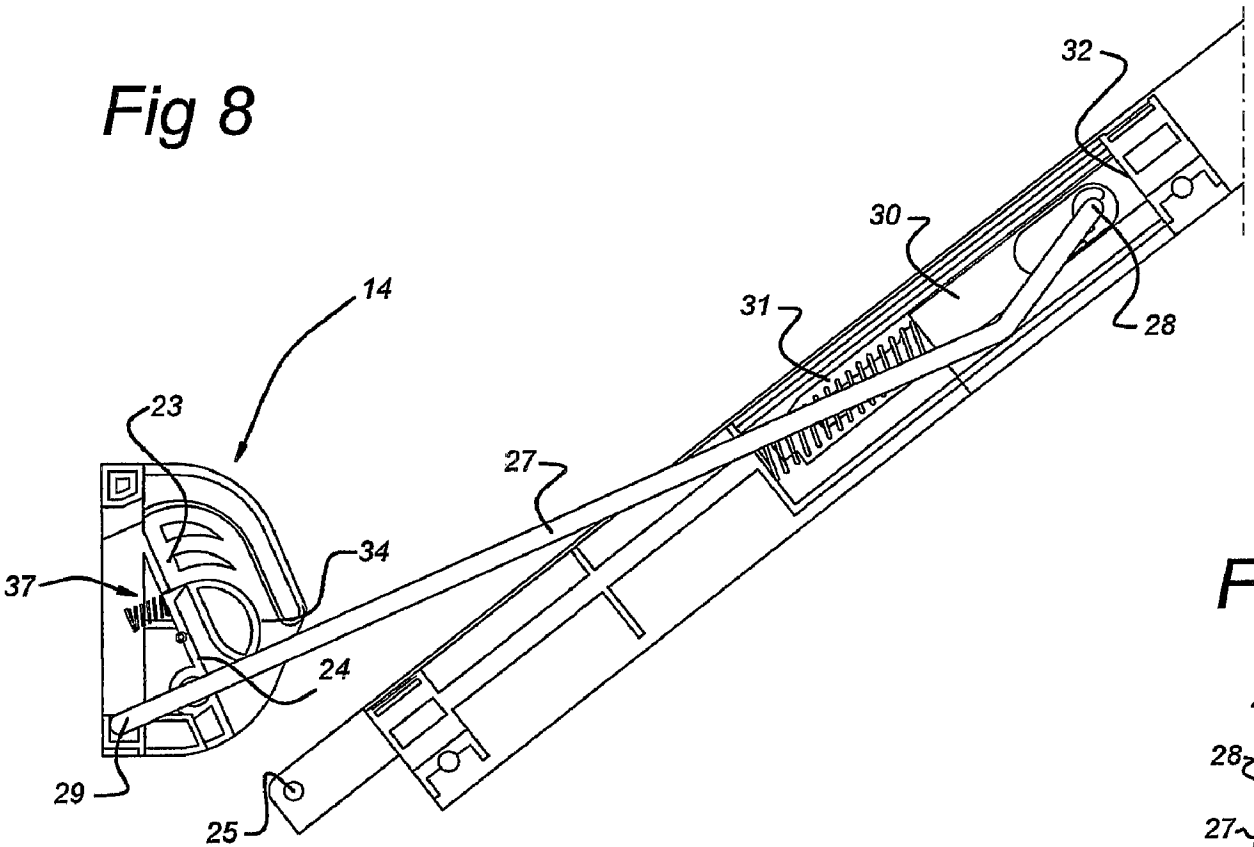
FIG. 8 shows the detail of FIG. 6 in the unlocked position.

When the coupling 14 is uncoupled, the frame is withdrawn in the direction away from the base piece 23, in such a manner that the pin 25 falls into the slot 34 via the curved slot 33 and can be pushed down. In this case, the coupling element rotates about the hinges 28, 29, as illustrated in FIGS. 7 and 8, to the folded-in position.

FIG. 10 shows that the stop face consists of two parts 24, between which the snap element 37 is accommodated. The pin 25 of the arm 7 rests on one respective part 24 with both ends and hooks behind the two sets of noses 38 of the snap element 37.

Although a particular suspension method has been described above, the invention is not limited thereto. It is also possible to connect the rod 7 to the suspension piece 13 so as to be displaceable. If required, the rod 7 can also be coupled to the suspension piece by means of a coupling element 26 which is hingedly connected to the suspension piece 13 on one side and to the rod 7 on the other side. It is also possible for the rod 7 to be of articulated design and to connect it to the suspension piece by means of a fixed hinge.

The invention claimed is:

1. A wall drying device adapted for mounting to a wall, said device comprising a frame which can be moved between a folded-in position and a folded-out position and which is provided with:

suspension means configured to suspend the frame from the wall;

one arm assembly comprising three or four arms of substantially equal length, which are distributed about equally around and hingedly connected to a single arm joint, each arm having first and second ends separated by a length of the respective arm;

lines extending in each case between two neighboring arms, and a rod assembly comprising at least three rods which are hingedly connected to a single rod joint, each rod having first and second ends separated by a length of the respective rod;

said rod assembly cooperating with the arm assembly, the arm assembly and the rod assembly being designed such that the arms extend substantially parallel in a first direction in the folded-in position at a relatively small distance next to one another and occupy a relatively small area in a direction transverse to the first direction, and in the folded-out position occupy a relatively large area in a direction transverse to the first direction;

each rod being connected to a respective one of the arms at a distance from the rod joint by means of a hinge, which hinge is located along the length between the respective first and second ends of the respective arm, each rod and each arm being substantially rigid between the hinge and the rod joint and arm joint, respectively;

one of the rods extending beyond the hinge of its respective arm, said rod extending beyond the hinge of its respective arm and its respective arm in the folded-out position being supported by the suspension means at a section of said rod extending beyond the hinge of its respective arm and at a section of its respective arm, said sections being at said respective first ends of said arm and said rod, which said first ends are opposite from said second ends which are connected to the rod joint and arm joint, respectively; and said section of said rod and said section of said arm being at a periphery of planes defined by the rod and arm assemblies, respectively, in the folded-out position, said sections being arranged such that said sections are configured to be in a plane that is substantially perpendicular to the wall in the folded-out position of the wall drying device; said section of said rod in the folded-out position being supported by the suspension means through a detachable coupling provided with a base piece and having a locking means comprising a snap element for detachably locking a counterpiece on said section of the rod relative to the base piece, the locking means locking the rod to the suspension means by snapping action of the snap element when the drying device is brought from the folded-in position into the folded-out position.

2. The wall-drying device as claimed in claim 1, in which in the folded-in position the arms and the rods are substantially parallel to one another and the distance between the rod joint and the arm joint is at a maximum.

3. The wall-drying device as claimed in claim 1, in which the distance between the rod joint and the arm joint is at a minimum in the folded-out position.

4. The wall-drying device as claimed in claim 1, in which the arm joint and the arms are provided with stops which interact with one another in the folded-out position.

5. The wall-drying device as claimed in claim 1, in which the rod joint and the rods are provided with stops which interact with one another in the folded-out position.

6. The wall-drying device as claimed in claim 1, in which the arm which is suported by the suspension means is preferably designed in two sections, comprising two parallel arm sections enclosing a gap, and the rod which is supported by suspension means is accommodated between those arm sections and hingedly connected thereto.

7. The wall-drying device as claimed in claim 1, in which the suspension means connected to the arm comprises a suspension piece which can be connected to the wall, which suspension piece is connected to the arm by means of a fixed hinge.

8. The wall-drying device as claimed in claim 1, in which the base piece can be connected to the wall, said base piece has at least one stop face and said counterpiece has at least one stop element such that the stop face is directed transversely to the rod in the stop position of the rod, in which the stop element bears against the stop face.

9. The wall-drying device as claimed in claim 8, in which the locking means are provided for locking the rod relative to the base piece.

10. The wall-drying device as claimed in claim 9, in which the snap element which is under resilient prestress can be displaced counter to a spring prestress by the counterpiece and which, once the stop position of the counterpiece has been reached, can rebound relative to the base piece in order to lock the counterpiece relative to the base piece.

11. The wall-drying device as claimed in claim 9, in which two of said stop faces and said respective stop elements are provided, and the snap element is located between the two stop faces.

12. The wall-drying device as claimed in claim 11, in which a guide is provided opposite each stop face, each said stop face and it's respective guide enclose a guide slot in such a manner that the respective stop element can be guided to the stop position through the guide slot.

13. The wall-drying device as claimed in claim 12, in which the guide slot has at least one lateral outlet opening into the guide for moving the stop element away from the stop.

14. The wall-drying device as claimed in claim 10, in which the snap element is opposite the outlet.

15. The wall-drying device as claimed in claim 14, in which a number of noses of the snap elements are provided in succession, viewed in the direction of the guide slot, opposite which snap elements an outlet is located.

16. The wall-drying device as claimed in claim 8, in which a coupling element is provided, one end of which is hingedly connected to the base piece and the other end of which is hingedly connected to the rod extending beyond the hinge of its respective arm at a distance from the counterpiece thereof.

17. The wall-drying device as claimed in claim 16, in which the coupling element is displaceably connected to the rod, in such a manner that the coupling element is directed away from the base piece in the longitudinal direction of the rod when the coupling element is in a coupled state.

18. The wall-drying device as claimed in claim 17, in which the coupling element is preloaded by spring prestress in a displacement direction, in such a manner that the rod is continuously pushed in the direction of the base piece when the coupling element is in the coupled state.

19. The wall-drying device as claimed in claim 16, in which the coupling element has two coupling parts extending parallel to one another between which said section of the rod extends.

20. The wall-drying device as claimed in claim 1, in which the suspension means comprise a suspension piece which is connected to one of the arms and to one of the rods.

21. The wall-drying device as claimed in claim 1, in which a handle is provided on a section of the arm assembly opposite from the section of the arm assembly on which the suspension means are provided.

22. The wall-drying device as claimed in claim 1, in which the hinge connecting the rods and their respective arms comprises a hinge pin.

* * * * *